US011370993B2

(12) United States Patent
Greene et al.

(10) Patent No.: US 11,370,993 B2
(45) Date of Patent: Jun. 28, 2022

(54) AQUEOUS RINSE AID COMPOSITION FREE OF POLOXAMER TYPE SURFACTANTS

(71) Applicants: Jeffrey A. Greene, Arlington, TN (US); Douglas Innes, Cordova, TN (US)

(72) Inventors: Jeffrey A. Greene, Arlington, TN (US); Douglas Innes, Cordova, TN (US)

( * ) Notice: Subject to any disclaimer, the term of this patent is extended or adjusted under 35 U.S.C. 154(b) by 0 days.

(21) Appl. No.: 16/434,139

(22) Filed: Jun. 6, 2019

(65) Prior Publication Data

US 2020/0385650 A1 Dec. 10, 2020

(51) Int. Cl.

| | |
|---|---|
| ***C11D 3/22*** | (2006.01) |
| ***C11D 1/66*** | (2006.01) |
| ***C11D 3/20*** | (2006.01) |
| ***C11D 1/74*** | (2006.01) |
| ***C11D 3/37*** | (2006.01) |
| ***C11D 3/40*** | (2006.01) |

(52) U.S. Cl.

CPC ..... *C11D 1/667* (2013.01); *C11D 1/74* (2013.01); *C11D 3/2065* (2013.01); *C11D 3/22* (2013.01); *C11D 3/3707* (2013.01); *C11D 3/40* (2013.01)

(58) Field of Classification Search

CPC ..... C11D 1/825; C11D 1/667; C11D 3/22; C11D 7/50; C11D 11/0023; C11D 17/0052; C11D 17/0091

See application file for complete search history.

(56) References Cited

U.S. PATENT DOCUMENTS 5,880,089 A * 3/1999 Lentsch ..... C11D 1/004 510/219

2016/0340613 A1* 11/2016 Kieffer ..... C11D 1/825

* cited by examiner

*Primary Examiner* — Charles I Boyer

(74) *Attorney, Agent, or Firm* — Baker Donelson

(57) ABSTRACT

An aqueous rinse aid solution for use in a dishwashing machine wherein the solution is substantially free of poloxamer type surfactants and wherein the solution produces water sheeting and spot-free dishware drying, the solution consists of food additives permitted for direct addition to food for human consumption and water.

6 Claims, No Drawings

AQUEOUS RINSE AID COMPOSITION FREE OF POLOXAMER TYPE SURFACTANTS

CROSS REFERENCES TO RELATED APPLICATIONS

This application is a continuation of the following patent application which is hereby incorporated by reference: U.S. patent application Ser. No. 15/411,771, filed on Jan. 20, 2017, entitled "Aqueous Rinse Aid Composition Free of Poloxamer Type Surfactants."

FIELD

This technology relates generally to an aqueous rinse aid composition and methods of making and using the same. The aqueous rinse aid composition is for use in a dish washing machine to produce water sheeting and spot-free dishware drying and is substantially free of poloxamer type surfactants.

BACKGROUND

It has been known for some time that rinse aids may be used during the drying cycle of a mechanical dish washing machine to eliminate water spots and produce streak-free dishes and glassware. Rinse aids contain surfactants which prevent droplet formation by allowing the water to drain from the surfaces of the dishware in thin sheets, rather than allowing droplets to form. Generally, such surfactants include poloxamer type surfactants which are not suitable for use in the food service industry. Poloxamer type surfactants are not generally recognized as safe by the USFDA (or "GRAS" ingredients).

There is a need for an aqueous rinse aid composition for use in a dishwashing machine that produces water sheeting and spot-free dishware drying wherein the rinse aid has a composition comprising components suitable for use in the food service industry and is substantially free of poloxamer type surfactants.

DETAILED DESCRIPTION

An aqueous rinse aid composition for use in a dishwashing machine that produces water sheeting and spot-free dishware drying is disclosed. The aqueous rinse aid composition comprises additives permitted for direct addition to food for human consumption. Additionally, the aqueous rinse aid composition is substantially free from poloxamers such as alkylene oxide block copolymers, that are currently the primary agents responsible for water sheeting and fast drying by covering dishware surfaces with a thin polymer film aliphatic surfactants that are not in the Food Codex as direct food additives.

In one example embodiment, the aqueous rinse aid composition is formulated into a concentrated solution and is delivered into each gallon of the rinse water used by the dish washing machine. In one embodiment, approximately, 0.5 to 3 ml of the concentrated formula is delivered into each gallon of rinse water.

In one embodiment, the aqueous rinse aid composition comprises the following food grade additives in the preferred ranges dissolved in water at 62.898 weight percent in formula:

(a) Sorbitol (70%) at 20.000% weight percent in formula; other common sugar alcohols such as mannitol and xylitol may be interchanged with sorbitol, as desired by one of skill in the art. In one embodiment, sorbitol functions as a sheeting agent;

(b) Glycerol (or Glycerin) at 5.000% weight percent in formula; in one embodiment, proplylene glycol may be interchanged with glycerol as desired by one of skill in the art. In one embodiment, glycerol functions as a sheeting agent;

(c) Polyethylene Glycol at 5.000% weight percent in formula. In one embodiment, Carbowax Sentry PEG 4600 is used. In another embodiment, small amounts of other sugar alcohol ester or alkyl polyglucosides may be used in place of polysorbate 80 for surface wetting purposes as desired by one of skill in the art as long as such sugar alcohol ester or alkyl polyglucosides are GRAS additives. In one embodiment, polyethylene glycol functions as a sheeting agent and an anti-foaming agent;

(d) Polysorbate 80 at 0.100% weight percent in formula which functions as a wetting agent and an anti-foaming agent;

(e) Citric Acid at 5.500% weight percent in formula, which functions as a builder in the composition;

(f) Glacial Acetic Acid at 1.500% weight percent in formula, which provides additional sheeting agent functionality; and (g) FD&C Blue #1 at 0.002% weight percent in formula, which is a colorant. Other food grade colorants may be used as desired by one skill in the art to alter the appearance of the composition.

In one embodiment, Applicants tested numerous formulas to determine the composition of the aqueous rinse aid composition, which is substantially free of poloxamer type surfactants, for use in a dish washing machine to produce water sheeting and spot-free dishware drying. Typical test conditions included the following: dish washing cycle had 200-250 ppm active alkalinity @140° F. for one minute; followed by rinse cycle having 1-2 ml rinse additive @ 140° F. for 30 seconds. Sheeting was observed immediately after wash cycle. Glassware dried for one hour before making spot and clarity assessment. Such formulations with respective results from testing are set forth below:

Formula A comprised the following raw materials at the percentages set forth: water 40%, citric acid 10%, propylene glycol 20%, glycerin 10% and rapeseed oil 20%. Formula A was not stable. The rapeseed oil split.

Formula B comprised the following raw materials in the noted percentages: propylene glycol 77.5%, rapeseed oil 0.8%, citric acid 6.2% and glycerin 15.5%. Formula B was stable, but did not produce desired sheeting action in dish machine final rinse drying.

Formula C comprised the following raw materials at the noted percentages: water 62.5%, propylene glycol 15.0%, glycerin 10.0%, alkyl polyglycoside C12-C16 0.2%, glacial acetic acid 2.0%, citric acid 10.0% and d-limonene 0.3%. Formula C was tested at 1.0 ml/gallon in dish machine final rinse on glassware. Sheeting was good with the dry results showing highly uniform sheeting action, but surface clarity needed improvement.

Formula D comprised the following raw materials in the noted percentages: water 62.5%, propylene glycol 15.0%, glycerin 5.0%, sorbitol (70%) 9.0%, alkyl polyglycoside C12-C16 0.5%, glacial acetic acid 2.0% and citric acid 6.0%. Formula D rinse was tested at 1.0 ml/gallon on lab dish machine and it had low foaming properties. The water sheeting was poor and glassware had severe spotting once dry.

Formula E comprised the following raw materials in the noted percentages: water 56.0%, alkyl polyglycoside C12-C16 4.0%, Tween 60 20.0%, Carbowax 600NF (polyethylene glycol) 10.0% and citric acid 10.0%. Formula E rinse was not stable; phase separation.

Formula F comprised the following raw materials in the noted percentages: water 52.0%, ethanol 8.0%, propylene glycol 5.0%, glycerin 5.0%, Tween 60 5.0%, Carbowax 600NF (polyethylene glycol) 10.0%, Carbowax 540NF (polyethylene glycol) 5.0% and citric acid 10.0%. Formula F was not stable; phase separation.

Formula G comprised the following raw materials in the noted percentages: water 57.0%, ethanol 10.0%, propylene glycol 10.0%, glycerin 10.0%, Tween 60 1.0%, Carbowax 600NF 2.5%, Carbowax 540NF 1.0% and alkyl polyglycoside C12-C16 0.5%. Formula G was not stable; phase separation.

Formula H comprised the following raw materials in the noted percentages: water 52.5%, ethanol 10.0%, propylene glycol 15.0%, glycerin 20.0%, Tween 60 1.0%, Carbowax 600NF 1.0% and alkyl polyglycoside C12-C16 0.5%. Formula H was not stable; phase separation. Observed split was either Carbowax or Tween 60 forming a phase separation. The poor water solubility of Tween 60 makes it the likely cause of this instability.

Formula I comprised the following raw materials in the noted percentages: water 27.8%, glycerin 45.0%, ethanol 6.0%, propylene glycol 10.0%, alkyl polyglycoside C12-C16 0.3%, citric acid 8.0%, acetic acid 1.5%, Tween 20 0.7% and Carbowax 600NF 0.7%. Formula I had a clouded appearance and is not stable.

Formula J comprised the following raw materials in the noted percentages: water 39.75%, glycerin 20.0%, ethanol 10.0%, propylene glycol 5.0%, Tween 20 5.0%, Carbowax 600NF 10.0%, citric acid 8.0%, acetic acid 1.0% and Span 20 1.25%. Formula J was stable but too foamy in the dish machine @ 1.0 ml per gallon.

Formula K comprised the following raw materials in the noted percentages: water 43.5%, glycerin 20.0%, ethanol 10.0%, propylene glycol 5.0%, Carbowax 600NF 10.0%, citric acid 8.0%, acetic acid 1.0% and Span 20 2.5%. Formula K was not stable and still too foamy in the dish machine @ 1.0 ml per gallon.

Formula L comprised the following raw materials in the noted percentages: water 30.5%, glycerin 20.0%, ethanol 20.0%, propylene glycol 10.0%, Carbowax 600NF 10.0%, citric acid 6.0%, acetic acid 1.0%, Span 20 2.5%. Formula L was again not stable and too foamy in the dish machine @ 1.0 ml per gallon.

Formula M comprised the following raw materials in the noted percentages: water 25.5%, glycerin 20.0%, ethanol 20.0%, propylene glycol 10.0%, Carbowax 600NF 10.0%, Tween 20 2.5%, alkyl polyglycoside C12-C16 2.5%, citric acid 6.0% and acetic acid 1.0%. Formula M was not made; a more dilute version was produced in its place.

Formula N comprised the following raw materials in the noted percentages: water 48.0%, glycerin 10.0%, ethanol 10.0%, propylene glycol 5.0%, Carbowax 600NF 5.0%, Tween 20 2.5%, Span 20 2.5%, tetra sodium EDTA (40%) 10.0%, citric acid 6.0% and acetic acid 1.0%. Formula N was not stable and too foamy in the dish machine @ 1.0 ml per gallon.

Formula O comprised the following raw materials in the noted percentages: water 51.0%, glycerin 10.0%, ethanol 10.0%, propylene glycol 5.0%, Carbowax 600NF 5.0%, Tween 20 7.5%, Span 20 2.5%, citric acid 8.0% and acetic acid 1.0%. Formula O was a stable formula but remained too foamy in the dish machine @ 1.0 ml per gallon. The surfactant levels are too high for low foaming rinse applications.

Formula P comprised the following raw materials in the noted percentages: oleic acid 25.0%, Tween 20 50.0% and Span 20 25.0%. Formula P was stable but much too foamy in the dish machine @ 1.0 ml per gallon. The fatty acid is not enough to provide de-foaming.

Formula Q comprised the following raw materials in the noted percentages: sorbitol (70%) 30.9%, Span 20 10.0%, glycerin 10.0%, Carbowax 600NF 5.0%, Tween 20 5.0%, water 7.5%, propylene glycol 2.5% and glycerin 8.0%. Formula Q is not stable, cloudy and phase separates.

Formula R comprised the following raw materials in the noted percentages: oleic acid 25.0%, Tween 20 25.0% and Span 20 50.0%. This formula at 1.0 ml/gallon water in the dish machine produced very good water sheeting on glassware and they were spotless on drying. The black box revealed very high clarity on glassware surfaces. However, the detergent cycle that follows on the next wash using the prior rinse produced foam; this was likely due to the detergent saponification of the oleic acid in the wash cycle combined with foaming from the Tween 20 being freshly released from emulsifying the oleic acid in the previous rinse water.

Formula S comprised the following raw materials in the noted percentages: mineral oil 66.6%, Span 20 25.0% and Tween 20 8.4%. Sample split.

Formula T comprised the following raw materials in the noted percentages: mineral oil 50.0%, Span 20 25.0% and Tween 20 25.0%. Sample split.

Formula U comprised the following raw materials in the noted percentages: water 62.0%, glycerin 10.0%, ethanol 5.0%, propylene glycol 5.0%, Tween 20 5.0%, Carbowax 540NF 1.0%, citric acid 8.0%, acetic acid 1.0%, Span 20 2.0% and Tween 60 1.0%. Sample almost clear, but still split upon standing.

Formula V comprised the following raw materials in the noted percentages: water 28.5%, glycerin 20.0%, ethanol 10.0%, propylene glycol 10.0%, tetra sodium EDTA (40%) 5.0%, Tween 20 5.0%, Carbowax 540NF 1.0, sorbitol (70%) 5.0%, Carbowax 600NF 4.0%, Span 20 2.0%, acetic acid 1.0% and citric acid 8.5%. Formula V was slightly too foamy in dish machine 1 ml/gallon; it has poor sheeting, and leaves shadows on glassware.

Formula W comprised the following raw materials in the noted percentages: water 55.15%, glycerin 11.82%, ethanol 11.05%, propylene glycol 7.59%, alkyl polyglycoside C12-C16 0.42%, Span 20 0.13%, Tween 20 0.34%, sorbitol (70%) 5.91%, acetic acid 0.84% and citric acid 6.75%. Sample was stable, but a reduced activity version was tried next in order to reduce the alcohol content.

Formula X comprised the following raw materials in the noted percentages: water 71.92%, glycerin 6.00%, ethanol 5.50%, propylene glycol 3.80%, alkyl polyglycoside C12-C16 0.84%, Span 20 0.26%, Tween 20 0.68%, sorbitol (70%) 3.00%, acetic acid 1.00% and citric acid 7.00%.

The Span 20 concentration was increased from concentration in Formula W and this produced hazy solution.

Formula Y comprised the following raw materials in the noted percentages: water 72.05%, glycerin 6.00%, ethanol 5.50%, propylene glycol 3.80%, alkyl polyglycoside C12-C16 0.80%, Span 20 0.15%, Tween 20 0.70%, sorbitol (70%) 3.00%, acetic acid 1.00% and citric acid 7.00%. Formula Y was stable and gives good sheeting on glassware @ 1.0 ml/gallon dosage. Although Formula Y produced good properties and was made of GRAS materials, an alcohol free version with a less complex formula was desired. The development focus was relined accordingly.

Formula Z comprised the following raw materials in the noted percentages: water 56.0%, Tween 80 15.0%, propylene glycol 10.0%, glycerin 10.0%, alkyl polyglycoside C12-C16 1.0%, acetic acid 1.0% and citric acid 7.0%. The foaming at 1.0 ml/gallon is low, the product produced sheeting on the glassware but is not as good as current technology. At 1.5 ml/gallon sample is too foamy in the dish machine.

Formula AA comprised the following raw materials in the noted percentages: water 55.0%, propylene glycol 15.0%, glycerin 10.0%, sorbitol (70%) 10.0%, acetic acid 1.0%, Tween 80 2.0% and citric acid 7.0%. Formula AA produced very good sheeting @ 1.0 ml/gallon and produced spot free and clear glassware surfaces on drying. A 1.4 liter sample was made and put into test service on a dish machine. Sample was later removed from dish machine due to spotting on glassware.

Formula BB comprised the following raw materials in the noted percentages: water 55.0%, sorbitol (70%) 27.0%, glycerin 10.0%, acetic acid 1.0% and citric acid 7.0%. Formula BB was tested at 1.5 ml/gallon in the dish machine; it did not sheet as well as Formula AA and was somewhat spotty on drying.

Formula CC comprised the following raw materials in the noted percentages: water 55.0%, sorbitol (70%) 19.4%, glycerin 10.0%, Tween 80 0.5%, Span 20 0.1%, ethanol 7.0%, citric acid 7.0% and acetic acid 1.0%. This formula had improved sheeting but still produced some glassware spotting; it was an improvement over Formula BB.

Formula DD comprised the following raw materials in the noted percentages: water 45.5%, sorbitol (70%) 20.0%, propylene glycol 15.0%, glycerin 5.0%, ethanol 5.0%, Tween 80 0.5%, citric acid 7.0% and acetic acid 2.0%. Sample not produced.

Formula EE comprised the following raw materials in the noted percentages: water 54.496%, sorbitol (70%) 19.400%, glycerin 10.000%, alkyl polyglycoside C8-C16 0.600%, ethanol 7.000%, citric acid 7.000%, acetic acid 1.500% and FD&C Blue #1 0.004%. Good water sheeting at 1.0 ml/gallon, but still some spotting left behind on the glassware, not acceptable.

Formula FF comprised the following raw materials in the noted percentages: water 53.896%, sorbitol (70%) 19.400%, glycerin 10.000%, alkyl polyglycoside C8-C16 1.200%, ethanol 7.000%, citric acid 7.000%, acetic acid 1.500% and FD&C Blue #1 0.004%. The water sheeting is better than Formula EE, it produced very good all-around results, and 1 gallon of this formula was put into dish machine for practical testing. Formula has increase wetting capacity over Formula GG.

Formula GG comprised the following raw materials in the noted percentages: water 53.296%, sorbitol (70%) 19.400%, glycerin 10.000%, alkyl polyglycoside C8-C16 1.800%, ethanol 7.000%, citric acid 7.000%, acetic acid 1.500% and FD&C Blue #1 0.004%. Formula GG had very good sheeting 1.0 ml/gallon, but still produced limited number of dried on spots and a completely spot free formula was one of the primary the technological target.

Formula HH comprised the following raw materials in the noted percentages: water 31.197%, sorbitol (70%) 30.000%, propylene glycol 12.000%, glycerin 12.000%, alkyl polyglycoside C8-C16 1.800%, ethanol 4.500%, citric acid 7.000%, acetic acid 1.500% and FD&C Blue #1 0.003%. Formula HH produced good sheeting at 1.0 ml/gallon; 1 gallon was made to replace Formula FF on the dish machine, glassware was still showing sporadic spotting on drying using Formula FF.

Formula II comprised the following raw materials in the noted percentages: water 44.597%, sorbitol (70%) 19.400%, glycerin 10.000%, alkyl polyglycoside C12-C16 0.500%, ethanol 7.000%, citric acid 7.000%, acetic acid 1.500%, Carbowax PEG 8000 (Sentry Food Grade) 10.000% and FD&C Blue #1 0.003%. Produced in order to check stability of PEG8000, no performance results recorded.

Formula JJ comprised the following raw materials in the noted percentages: water 28.077%, sorbitol (70%) 27.000%, propylene glycol 10.800%, glycerin 10.800%, alkyl polyglycoside C8-C16 1.300%, Tween 80 0.500%, ethanol 4.050%, citric acid 6.300%, acetic acid 1.350%, Carbowax PEG 8000 (Sentry Food Grade) 9.820% and FD&C Blue #1 0.003%. Formula JJ sheets the rinse solution well and produced a spotless result on glassware at typical dosage. The solution was a little foamy indicating that surfactant reduction was necessary.

Formula KK comprised the following raw materials in the noted percentages: water 29.397%, sorbitol (70%) 27.000%, propylene glycol 10.800%, glycerin 10.800%, alkyl polyglycoside C12-C16 0.500%, ethanol 4.000%, citric acid 6.300%, acetic acid 1.400%, Carbowax PEG 8000 (Sentry Food Grade) 9.800% and FD&C Blue #1 0.003%. Formula KK did provide sheeting action at 1.0 ml/gallon, but glassware had some spotting on drying. In contrast, Formula JJ had much fewer spotting and better, faster wetting and sheeting. No foam.

Formula LL comprised the following raw materials in the noted percentages: water 29.397%, sorbitol (70%) 27.000%, Carbowax 540NF 20.300%, propylene glycol 5.800%, glycerin 5.800%, ethanol 4.000%, citric acid 6.300%, acetic acid 1.400% and FD&C Blue #1 0.003%. This sample produced good results with sheeting and had low spotting on glassware in the 1-2 ml/gallon concentration range. No foam.

Formula MM comprised the following raw materials in the noted percentages: water 29.397%, sorbitol (70%) 27.000%, Carbowax PEG 8000 (Sentry Food Grade) 20.300%, propylene glycol 5.800%, glycerin 5.800%, ethanol 4.000%, citric acid 6.300%, acetic acid 1.400% and FD&C Blue #1 0.003%. Formula MM also produced good results with sheeting and had low spotting on glassware in the 1-2 ml/gallon concentration range. No foam.

Formula NN comprised the following raw materials in the noted percentages: water 29.397%, sorbitol (70%) 27.000%, Carbowax PEG 8000 (Sentry Food Grade) 20.300%, propylene glycol 5.000%, glycerin 5.000%, alkyl polyglycoside C8-C16 1.600%, ethanol 4.000%, citric acid 6.300%, acetic acid 1.400% and FD&C Blue #1 0.003%. Excellent results, but foamy in the machine.

Formula OO comprised the following raw materials in the noted percentages: water 58.847%, sorbitol (70%) 13.500%, Carbowax PEG 8000 (Sentry Food Grade) 10.150%, propylene glycol 2.900%, glycerin 2.900%, ethanol 4.000%, citric acid 6.300%, acetic acid 1.400% and FD&C Blue #1 0.003%. This was the final ethanol containing formula; it replaced Formula FF in the dish machine and gave reliably good results in all measures. Applicant discontinued using ethanol; ethanol was formulated out of the technology at this point even though it worked well as a flash solvent promoting quick sheeting.

Formula PP comprised the following raw materials in the noted percentages: water 58.847%, sorbitol (70%) 13.500%, propylene glycol 6.900%, glycerin 2.900%, Carbowax PEG-4600 (Sentry Food Grade) 10.150%, citric acid 6.300%, acetic acid 1.400% and FD&C Blue #1 0.003%. Formula PP also performs very well at 1.0 ml/gallon, equal to Formula OO at typical concentration range.

Formula QQ comprised the following raw materials in the noted percentages: water 67.111%, sorbitol (70%) 10.125%, propylene glycol 5.175%, glycerin 2.175%, Carbowax PEG-4600 (Sentry Food Grade) 7.612%, citric acid 6.300%, acetic acid 1.500% and FD&C Blue #1 0.002%. This formula produced good sheeting at 1.2 ml/gallon; however there were a few spots on the glassware.

Formula RR comprised the following raw materials in the noted percentages: water 62.998%, sorbitol (70%) 20.000%, glycerin 5.000%, Carbowax PEG-4600 (Sentry Food Grade) 5.000%, citric acid 5.500%, acetic acid 1.500% and FD&C Blue #1 0.002%. Formula RR produced superior results for quick sheeting and anti-spotting on glassware at typical concentration ranges. A gallon of this formula was made and it was put onto the dish washing machine replacing Formula OO.

Formula SS comprised the following raw materials in the noted percentages: water 62.898%, sorbitol (70%) 20.000%, glycerin 5.000%, Carbowax PEG-4600 (Sentry Food Grade) 5.000%, Tween 80 0.050%, alkyl polyglycoside C12-C16 0.050%, citric acid 5.500%, acetic acid 1.500% and FD&C Blue #1 0.002%. This formula also produced superior results for quick sheeting and anti-spotting on glassware at typical concentration ranges. A gallon of this formula was made and put onto the dish machine replacing attempt 40 formula.

Formula TT comprised the following raw materials in the noted percentages: water 61.998%, sorbitol (70%) 20.000%, glycerin 5.000%, Carbowax PEG-4600 (Sentry Food Grade) 5.000%, Tween 80 0.500%, alkyl polyglycoside C12-C16 0.500%, citric acid 5.500%, acetic acid 1.500% and FD&C Blue #1 0.002%. Formula TT produced results displaying good sheeting and very low spotting with excellent clarity on the glassware on drying at typical concentration range, but the increased surfactant level did not boost performance over Formula SS. A 35 gallon batch was produced for field testing, and field test confirmed excellent result in this market. Formula TT concluded the product development phase for this technology. The remaining R&D effort was focused on field testing the final form of Formula SS with the only formula change being the replacement of Alkyl polyglycoside C12-C16 with Tween 80 (only) for a final concentration of 0.1% Tween 80 in Formula SS base formula.

The description and illustrations are by way of example only. While the description above makes reference to various embodiments, it should be understood that many changes and modifications can be made without departing from the scope of the disclosure. Many more embodiments and implementations are possible within the scope of this invention and will be apparent to those of ordinary skill in the art. The technology is not limited to the specific details, representative embodiments, and illustrated examples in this description.

We claim:

1. A concentrated aqueous rinse aid solution which when diluted with water will produce an aqueous rinse aid solution comprising:

a. at least one sugar alcohol;

b. at least one polyol compound;

c. polyethylene glycol;

d. at least one nonionic surfactant; and e. citric acid, wherein the solution is substantially free of poloxamer surfactants and wherein the solution produces water sheeting and spot-free dishware drying, the solution consists of food additives permitted for direct addition to food for human consumption and water; and wherein the solution comprises no more than 1% surfactant by weight.

2. The solution of claim 1 wherein the at least one nonionic surfactant is polysorbate 80.

3. The solution of claim 1 wherein the at least one nonionic surfactant is polysorbate 80 and alkyl polyglycoside C12-C16.

4. The solution of claim 1 wherein the solution further comprises a food grade colorant.

5. The solution of claim 4 wherein the food grade colorant is FD&C Blue #1.

6. The solution of claim 1 wherein the solution comprises no more than 0.1% surfactant by weight.

* * * * *